United States Patent [19]

Pouzoulet

[11] Patent Number: 4,610,479

[45] Date of Patent: Sep. 9, 1986

[54] CHAIR WITH RAISABLE SEAT, PARTICULARLY FOR THEATERS

[75] Inventor: Claude Pouzoulet, Le Raincy, France

[73] Assignee: Quinette International S.A., Montreuil, France

[21] Appl. No.: 708,621

[22] Filed: Mar. 5, 1985

[51] Int. Cl.[4] ..... A47C 1/121

[52] U.S. Cl. ..... 297/332; 297/335; 297/336

[58] Field of Search ..... 297/331, 332, 333, 335, 297/336

[56] References Cited

U.S. PATENT DOCUMENTS

| | | | |
|---|---|---|---|
| 2,652,881 | 9/1953 | Rowe | 297/332 |
| 3,309,136 | 3/1967 | Kehoe | 297/296 |
| 3,638,982 | 2/1972 | Chapman et al. | 297/332 |
| 4,458,942 | 7/1984 | Crossman | 297/332 |

FOREIGN PATENT DOCUMENTS

| | | | |
|---|---|---|---|
| 225871 | 2/1963 | Austria | 297/333 |
| 1024057 | 1/1978 | Canada | 297/336 |
| 2018009 | 5/1970 | France . | |
| 2371905 | 6/1978 | France . | |
| 1556167 | 11/1979 | United Kingdom . | |

*Primary Examiner*—William E. Lyddane
*Assistant Examiner*—Peter R. Brown
*Attorney, Agent, or Firm*—Sughrue, Mion, Zinn, Macpeak and Seas

[57] ABSTRACT

A theater chair comprises a floor support 2, an upwardly open U-shaped iron fitting 3 fixed to the support, its front limb 32 bearing a seat 4 hinged around an axis 32 spaced from its rear edge, the latter retracting within the limbs of the U-shaped fitting when the seat is raised. The rear 36 limb bears the backrest 5 and, optionally, armrests 6.

7 Claims, 9 Drawing Figures

CHAIR WITH RAISABLE SEAT, PARTICULARLY FOR THEATERS

BACKGROUND OF THE INVENTION

The present invention relates to chairs of which the seat is raisable, and more particularly to chairs of this type designed for theaters.

In a theater, of course, the minimum distance between chairs of two successive rows is governed by safety standards. This distance is reckoned between the most projecting part of a chair of a given row with respect to the backrest of the chair of the preceding row. It is therefore essential, in order to be able to install the maximum number of chairs in a theater of given size, for the seat to be raisable as much as possible against the backrest.

The minimum overall dimension is determined by the length of the armrests designed in view of comfort if the raised seat is entirely received between these armrests. Chairs comprising two lateral legs to which are fixed two hinge casings generally have this minimum overall dimension determined by that of the armrests. However, the mounting of seat assemblies of this type is complex and the number of parts to be adjusted important. Moreover, the lateral position of the legs can constitute a constraint for the spectators and the appearance thereof is unattractive.

These drawbacks have been avoided by chairs with raisable seats for which the support means comprise a single central leg, such as that described in French Pat. No. 2 155 042.

In this case, a single hinge casing is fixed to the leg, and the seat is connected to the casing through its rear edge.

However, the overall dimension of these chairs is relatively large, since the rear of the seat cushion abuts against the backrest in its raised position so that the front edge of the seat projects distinctly forward of the end portion of the armrest. Here the overall dimension which must be satisfied to respect the safety standards is hence determined, not by the armrests, but by the raised seat.

In addition, considering the distance between the hinge axis and the center of gravity of the seat, a very powerful return spring is necessary to obtain automatic raising, and the hinge casing supporting considerable forces, it is of very heavy construction. The large return force necessary generally involves the use of a helical spring mounted around the hinge axis and working in torsion. This type of use causes fairly rapid fatigue of the spring, which, associated with the contingent wear of the cushions, results in a raised position less and less high with time as well as variations in the raised position over a row. These variations constitute a threat to safety, detract from the appearance and entail upkeep costs.

Finally, in known chairs with a raisable seat, the hinge casings are welded to the support means or fixed to the latter at a well-determined angle with respect to its axis. The assembly of the support means and the casing must therefore be adapted to the slope of the floor on which the chair must be fixed, in order that the slope of the seat may correspond to the conformation of the theater. If on delivery, there appears a difference between the theoretical and the actual slopes, the whole stock of support means and casings of all the chairs must be changed or chocks must be used, enormously complicating installation. On the other hand, the angle formed with the floor by the axis of the support means varies with the theater, and if a support cover is required, it must be manufactured to order.

GENERAL DESCRIPTION OF THE INVENTION

To avoid these various drawbacks, an object of the invention is to provide a chair with a raisable seat whose overall dimension is minimal, mounting simple, mechanism light, robust and reliable, aesthetic appearance favorable, comfort optimal and adaptation to a floor slope easy.

The invention therefore provides for this purpose a chair comprising a support means supporting a backrest, a hinged seat and possibly armrests, said support means including a unit which, seen in profile, has a general shape of an upwardly-open U connected through its web to a stay fixed to the floor, one of the limbs being situated at the back and bearing the backrest, the other limb being situated at the front and bearing the seat through a hinge, the hinge axis being spaced from the rear end of the seat so that a portion of the latter is received between the limbs of the U when it is raised, wherein a leaf spring is fixed to the front limb of the generally U-shaped unit, and cooperates with a lever-forming element fixed to the seat so as to urge it towards its raised position.

According to another advantageous feature of the invention, the generally U or V-shaped unit comprises a single part of stamped sheet-metal.

According to a further advantageous feature of the invention, the support means comprises a central leg fixed to the floor and to the upper end of which is removably fixed, said generally U-shaped unit.

BRIEF DESCRIPTION OF THE DRAWINGS

Other features and advantages of the invention will appear from the following description of a preferred embodiment explained with reference to the accompanying drawings, in which.

DESCRIPTION OF PREFERRED EMBODIMENTS

Figure 2:
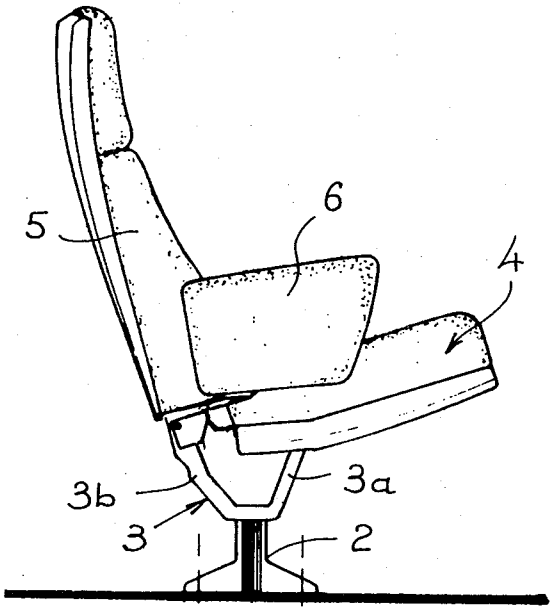
FIG. 2 shows the chair of FIG. 1 also in profile, with the seat lowered.
Figure 1:
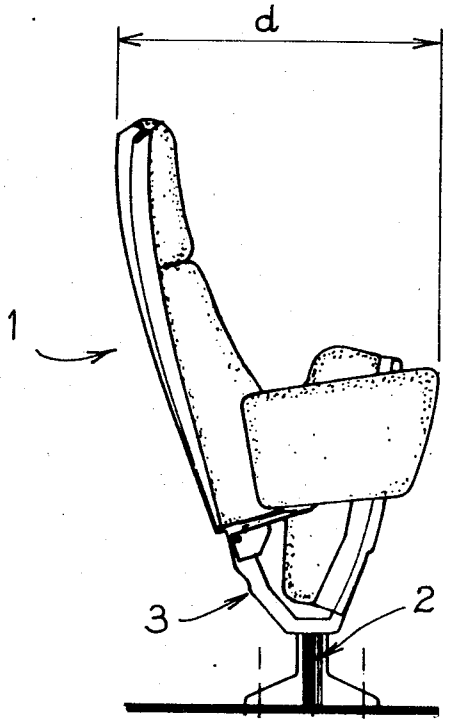
FIG. 1 shows a chair according to the invention seen in profile, with the seat raised.

A chair 1 according to the invention is shown as a whole in FIGS. 1 and 2 seen in profile. Its support means comprises a leg 2 at the top of which is fixed an iron fitting 3 which has, seen in profile, an upwardly-open general U-shape. A seat 4 is hinged to the limb or wing 3*a* of this iron fitting, whilst the limb or wing 3*b* is adapted to receive a backrest 5 and armrests 6 are fixed thereto.

Figure 7:
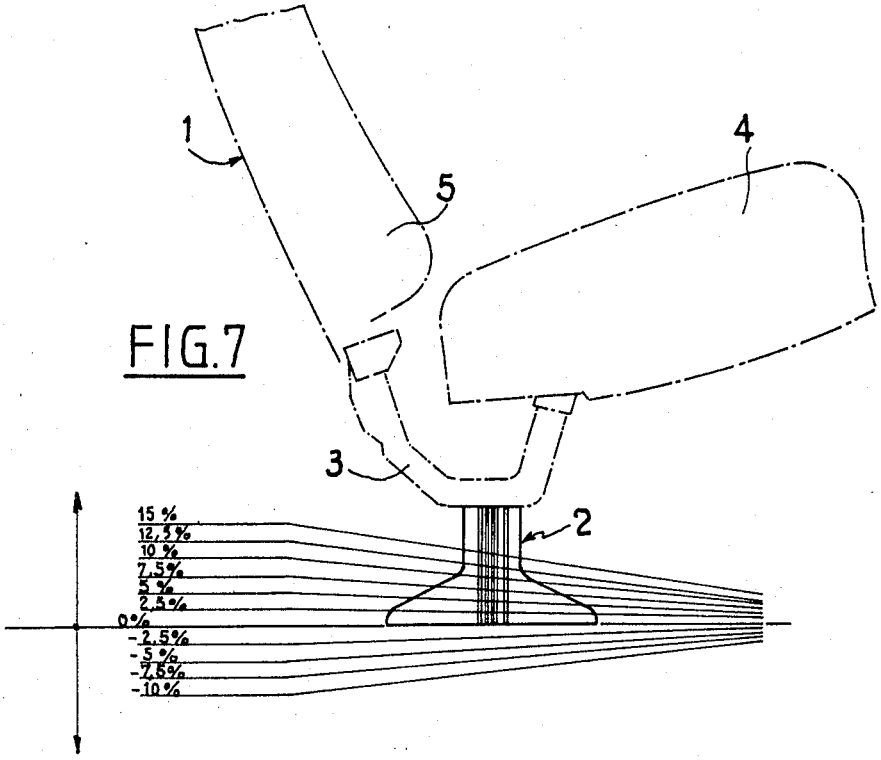
FIGS. 7, 8 and 9 show the adaptation of the leg and of its cover to a floor of given slope.
Figure 8:
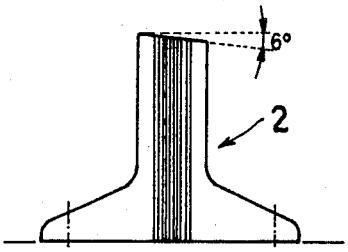
Figure 9:
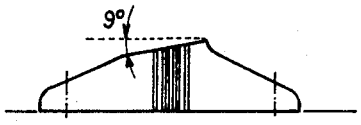

The leg 2 comprises a shaft 8 of metal tubing with rectangular cross section whose lower end is cut at right angles and welded to a plate 9 of sheet metal, designed to be fixed to the floor by means of screws. A cover 10, of plastics material, for example injection-molded, conceals the whole of the leg 2. The upper end of the shaft 8 is cut at an angle determined as a function of the slope of the floor and of the desired inclination of the seat 4, as indicated in FIGS. 7, 8 and 9. A metal plate 11 is welded to this end, and also comprises threaded orifices for fixing the iron fitting 3.

The latter is obtained by stamping an approximately rectangular sheet metal plate. The rear wing or limb 3*b* of this generally U-shaped structure is substantially longer than the front wing or limb 3*a*, and both are oriented upwards and slightly inclined outwardly.

The lateral edges 3*c* are folded back to a right angle towards the inside of the U in order to stiffen the iron fitting. Web 3*d* connecting the two limbs 3*a* and 3*b* is almost flat and fixed by screws 12 to the plate 11.

An axle support 13, of acetal resin, for example, provided with side-notches 14 forming bearings, cap the upper edge of the wing 3*a*. To the practically flat inner face of the latter is fixed a leaf-spring 15 by means of a screw 16 passing through the wing 3*a* and screwed into a cage-nut 17 fast to the leaf spring 15. The upper end 15*a* of the latter is curved back towards the front to form a semi-cylindrical latching portion with axis parallel to the axis of the notches 14 but slightly shifted, situated opposite a cut-out 18 formed on the upper edge of the wing 3*a* and masked by the support 13.

A fastening fork of the backrest 5 is fixed by means of screws (not shown) on the inner surface of the upper end of the rear wing 3*b* of the structure 3. It comprises a sheet metal plate 19 to the lateral ends of which are welded two parallel square tubes 20 extending obliquely upwards. An adjusting screw 21 only the head of which is visible from outside the structure 3, is screwed into a threaded orifice 22 formed in the plate 19 to permit adjustment of the inclination of the tubes 2C, and hence that of the backrest 5 fitted on these tubes 20.

A bridging member 23 is welded to the rear upper end of the lateral edges 3*c*, and supports rigid steel arms 24, to which are fixed iron fittings 25 to which are attached the armrests 6.

A metal lug 26 is welded to the middle of the lower surface of the member 23 and serves as a stop for the seat 4 when it is lowered.

The latter comprises essentially a foam cushion 27 covered with upholstery 28 and fixed to a rigid case 29, for example of plastics material molded by injection under pressure. At the rear of the case 29 is provided a rectangular cavity to receive a plate 30 for hinging the seat, of stamped sheet-metal. Its lateral edges 30*a* are flanged and their rear ends 30*b* are folded back against the rear edge of the case to which they are fixed by screws 31.

Figure 3:
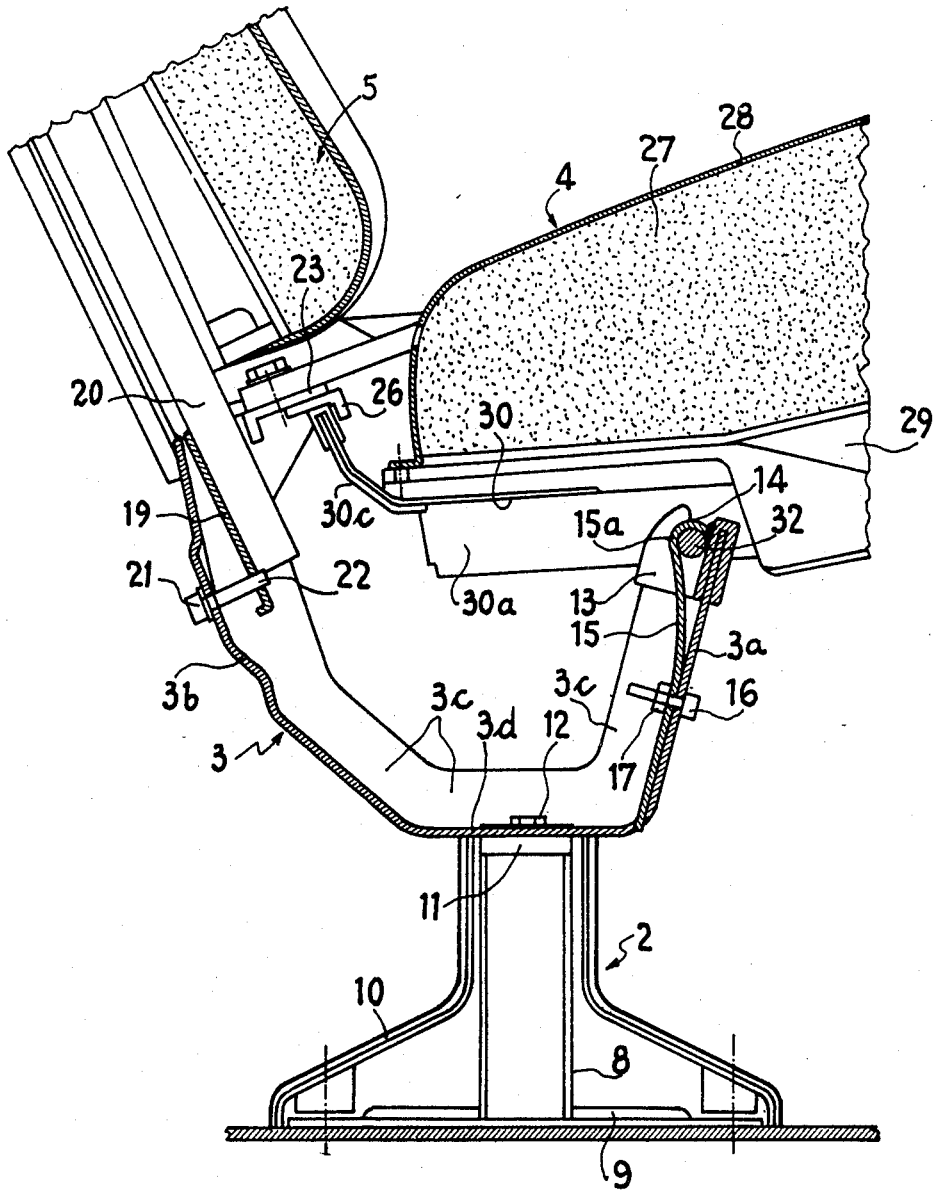
FIG. 3 is a vertical section of the chair through the middle plane.

An extension 30*c* from plate 30, covered with rubber or other elastic material at its end, projects rearwards and upwards as shown in FIG. 3.

An axle 32, constituted by a round steel rod bent into a crank shape is welded transversly to the lateral edges 30*a*.

Figure 4:
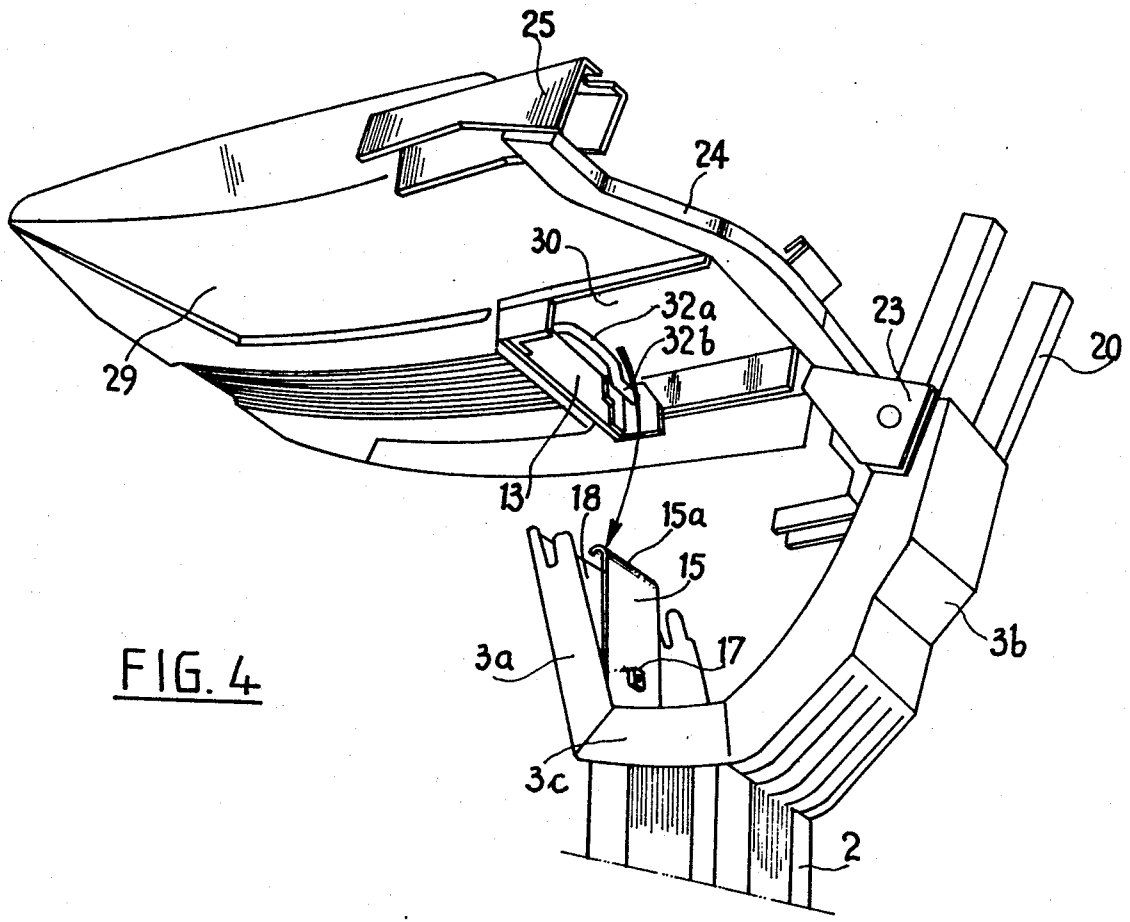
FIG. 4 shows diagramatically in partly exploded perspective a detail of the chair seen from below.
Figure 5:
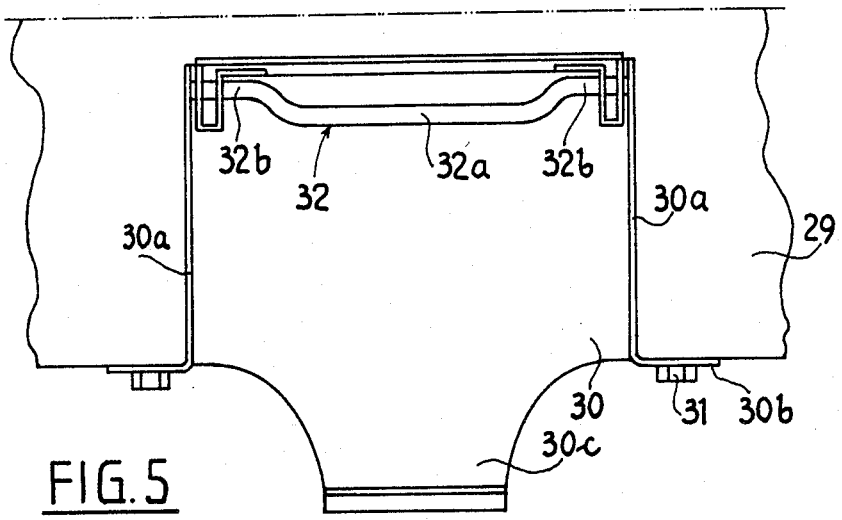
FIG. 5 shows a view from below of the seat of the chair.
Figure 6:
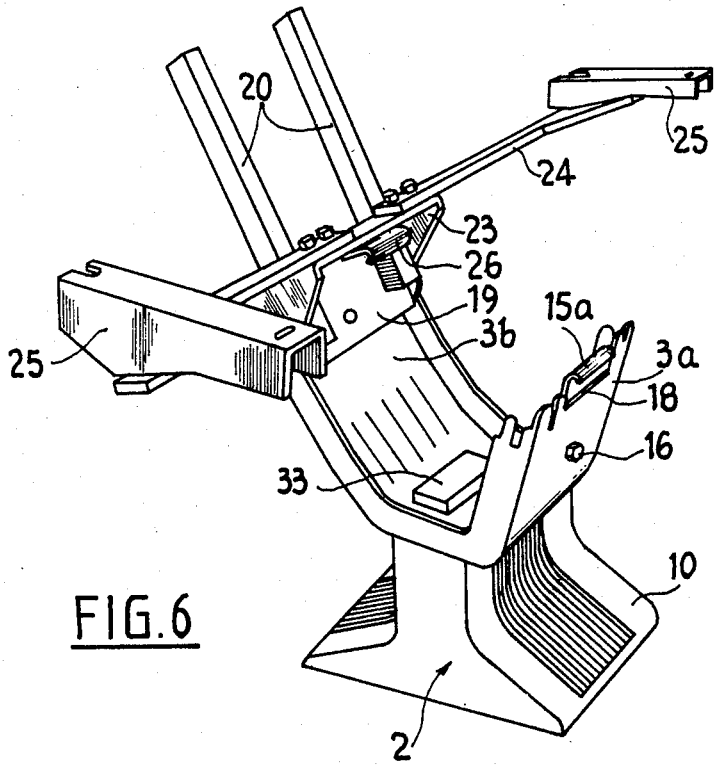
FIG. 6 shows in perspective the leg of the chair with the supports of the backrests and of the armrests.

This axle is slightly spaced vertically from the plate 30, and is at a distance from the edge of the seat of about a quarter of the total length of the latter (see FIG. 4). The central portion 32*a* of this axle is parallel to its lateral portions 32*b* but slightly eccentric rearwards and downwards when the seat is lowered.

These lateral portions 32*b* are received in notches 14 of the support 13, whilst the portion 32*a* is in engagement with the hook-shaped portion 15*a* of the leaf-spring 15. The latter therefore impresses a rotary torque on the axle 32 in anti-clockwise direction (seen in FIG. 3) so that the seat 4 is always urged towards its raised position.

The seat 4 is hence hinged around the axle 32, and its extreme positions are determined on the one hand by the extension 30*c* and the lug 26 for the lowered position, and on the other hand by this same extension 30*c* and a foam pad 33 fixed, for example, by glueing to the bottom of the iron fitting 3, as regards the raised position. In the latter position, the rear portion of seat 4 is received between the wings of the iron fitting 3 (FIG. 1). Consequently, the seat 4 can be turned back without obstacle against the backrest 5 between the armrests 6, and the maximum longitudinal overall dimension of the chair is limited to a distance d (FIG. 1) defined between the rear end of the backrest 5 and the front end of the armrests 6. Moreover, the stop 26 and the extension 30*c* form an accurate and reliable stop device for the lowered position, so that this position does not vary in the course of the use of the chair.

On the other hand, the position of the axle 32 spaced from the rear edge of the seat 4, considerably reduces the return torque ncessary to raise the seat 4, since the seat portion situated behind the axle 32, with its hinge plate 30, forms a counterweight when the seat is raising.

The spring therefore exerts less force on the support means and on the hinge which can thus be lightened with respect to prior art structures.

In addition, a leaf spring 15 with a small range of movement may be employed, which simplifies construction and mounting of the chair, since it is fixed and tensioned by a single screw 16. Also, the reliability and life of the whole of the chair is increased, in spite of the lightening of the parts.

In modifications which are not shown in the drawings, the U-shaped iron fitting 3 may be replaced by two independent metal members extending approximately vertically to the front and to the rear of the support means. These members can then be fixed to a floor plate with a certain separation between them to define the space into which the rear portion of seat 4 can be retracted.

In the same way, various structures may be adopted for the seat and the backrest; the case 29, for example, can be replaced by a rigid structure provided with a visible covering also on its inner surface.

Having now described my invention what I claim as new and desire to secure by Letters Patent is:

1. A theater chair, comprising:

(a) an upstanding support member (2) having a lower portion adapted to be fixed to a floor, (b) a mounting unit (3) having an upwardly open U-shaped profile defined by a front limb (3*a*) having an upper edge, a rear limb (3*b*), and a central web (3*d*) connecting said limbs together and fixed to an upper portion of the support member, (c) a backrest (5) mounted to the rear limb, (d) a seat (4), (e) hinge means mounting a rearward portion of the seat to the front limb about a hinge axis (32*b*) spaced inwardly from a rear edge of the seat such that a rearwardly overhanging portion of the seat is received between the mounting unit limbs when the seat is in a raised position, (f) a lever-forming member (32*a*) fixed to the seat and disposed parallel to the hinge axis, and (g) a leaf spring (15) fixed to the front limb and defining a latching portion (15*a*) disposed at the level of the upper edge of the front limb and engaging the lever-forming member to urge the seat towards its raised position.

2. A chair according to claim 1, wherein the lever-forming member comprises an eccentric portion of a hinge axle of the seat, said axle being crank shaped and being rotatably mounted at ends thereof on the front limb.

3. A chair according to claim 2, including an axle support (13), preferably of plastics material, disposed to cap said front limb upper edge, and in which the ends of the hinge axle are received.

4. A theater chair according to claim 3, wherein the leaf spring is fixed to an inner face of the front limb, oriented towards the rear limb.

5. A theater chair according to claim 2, wherein the leaf spring is fixed to an inner face of the front limb, oriented towards the rear limb.

6. A chair according to claim 1, further comprising arms mounted on the rear limb, iron fittings (25) fixed to said arms, and armrests (6) mounted on said fittings.

7. A theater chair according to claim 1, wherein the leaf spring is fixed to an inner face of the front limb, oriented towards the rear limb.

* * * * *